US006021698A

United States Patent [19]

Otto et al.

[11] Patent Number: 6,021,698

[45] Date of Patent: Feb. 8, 2000

[54] STAGER INTERFACE APPARATUS AND METHOD FOR STAGING SHEETS

[75] Inventors: Edward M. Otto, Bethlehem; David M. Skvoretz, Northampton, both of Pa.

[73] Assignee: Bell & Howell Mail & Messaging Technologies Co., Durham, N.C.

[21] Appl. No.: 09/070,257

[22] Filed: Apr. 30, 1998

[51] Int. Cl.[7] ..... B26D 7/06; B26D 7/01

[52] U.S. Cl. ..... 83/23; 83/282; 83/452

[58] Field of Search ..... 83/155, 156, 209, 83/282, 452, 461, 23, 27

[56] References Cited

U.S. PATENT DOCUMENTS 4,699,031 10/1987 D'Angelo et al. ..... 83/23

5,020,403 6/1991 D'Angelo et al. ..... 83/171

5,362,039 11/1994 Kusters ..... 271/225

5,595,102 1/1997 O'Grady ..... 83/435.17

*Primary Examiner*—M. Rachuba

*Assistant Examiner*—T. Anthony Vaughn

*Attorney, Agent, or Firm*—Jenkins & Wilson, P.A.

[57] ABSTRACT

A stager interface apparatus and method for staging two-up printed material are disclosed. The stager interface apparatus and method, in the form of a cutter stager, by independently holding each piece of printed material, allow side-by-side printed material to be released downstream either simultaneously or sequentially dependent upon downstream requirements.

21 Claims, 5 Drawing Sheets

STAGER INTERFACE APPARATUS AND METHOD FOR STAGING SHEETS

TECHNICAL FIELD

The present invention relates generally to a stager interface apparatus and a method for staging sheets. In particular, the invention is directed to a cutter stager interface apparatus and method for staging sheets. In particular, the invention is for use in the feeding and handling of "two-up" printed material.

The invention is further for use in an environment in which a downstream operation uses "two-up" printed material, in the form of side-by-side sheets, and feeds the side-by-side sheets to the downstream operation either sequentially or simultaneously.

BACKGROUND ART

Various cutters and stager apparatuses and methods have existed in the past with application in sheet processing.

While in the past, numerous devices and methods for operating against this background were implemented and were at times suitable for their intended uses, there remains room for improvement within the art.

DISCLOSURE OF THE INVENTION

It is an object of the invention to provide a novel stager interface apparatus and method for use with a device that separates sheets from a web.

It is a further object of the invention to provide a stager interface apparatus and method particularly suitable for use with a cutter.

It is yet a further object of the invention to provide a stager interface apparatus and method that allows side-by-side sheets cut in a predetermined sequence to be either simultaneously or sequentially fed downstream.

These and other objects of the invention are achieved by a stager interface apparatus and method comprising: a sheet feeding mechanism for feeding first and second side-by-side sheets cut by and coming out of the cutter; and a sheet holding mechanism for holding the first and second side-by-side sheets in place after exiting the cutter, the sheet holding mechanism further comprising a controller for selectively releasing each of the first and second side-by-side sheets from the sheet holding mechanism to the sheet feeding mechanism.

These and other objects of the invention are also achieved by a method for staging sheets, comprising the steps of: providing first and second webs to a separator; feeding the first and second webs through the separator; stopping feeding the first and second webs after at least a portion of the first and second webs pass through the separator; separating the portions of the first and second webs that passed through the separator from the rest of the first and second webs to form first and second sheets; and selectively feeding the first and second sheets in a predetermined sequence.

Some of the objects of the invention having been stated hereinabove, other objects will become evident as the description proceeds, when taken in connection with the accompanying drawings as best described hereinbelow.

BEST MODE FOR CARRYING OUT THE INVENTION

With reference to the drawings, a stager interface apparatus and method for staging sheets that meets and achieves the various objects of the invention set forth above will now be described.

Figure 4:
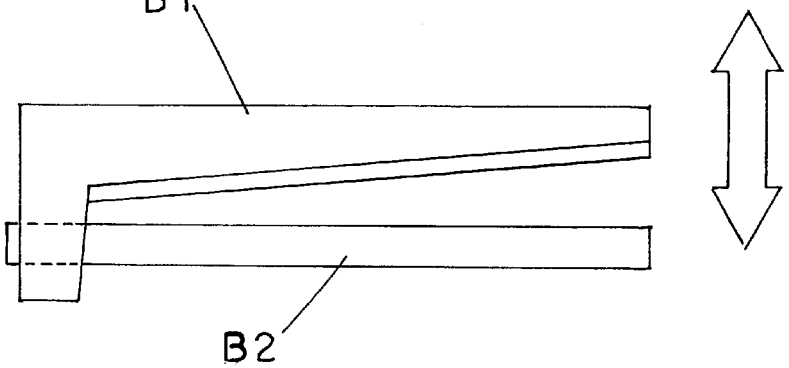
FIG. 4 of the drawings is a simplified elevation view depicting the blades of a conventional web cutter as contemplated for use with the cutter stager according to the invention.
Figure 5:
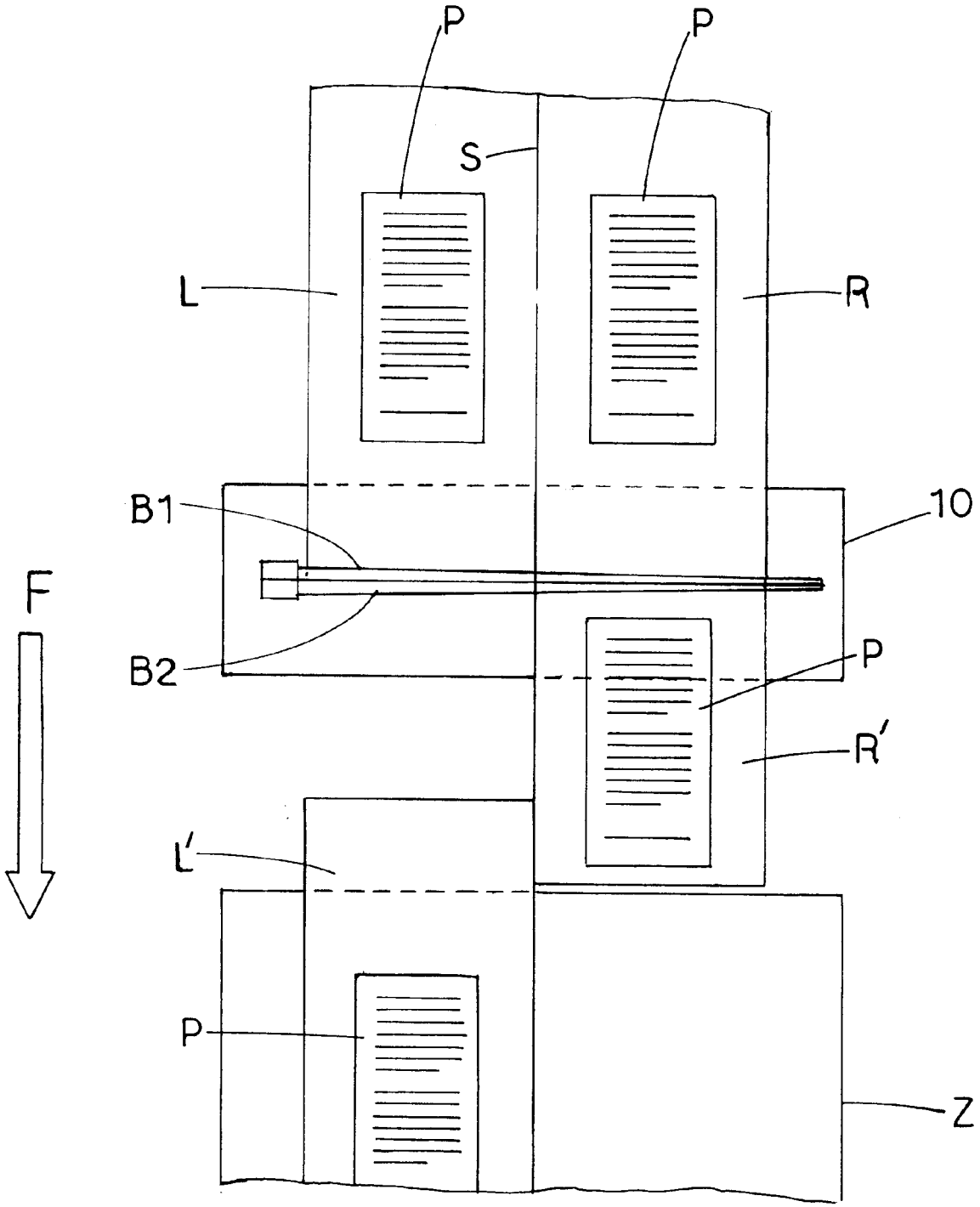
FIG. 5 of the drawings is a plan schematic view of a typical two-up cutter application.

FIG. 5 of the drawings is a plan schematic view of a typical two-up cutter application. In particular, left and right sheet webs L, R are fed into a cutter 10. Left and right webs L, R are typically formed by slitting a wider web down its longitudinal center line to form two parallel but narrower webs separated by a very narrow slit S (FIG. 5). Inside cutter 10 are two blades B1, B2. As shown in FIG. 4, vertically movable blade B1 acts as a guillotine with respect to stationary blade B2. Due to this structure, and as will be described in detail below, left sheet L' will separate from left web L before right sheet R' separates from right web R. Accordingly, since the sheet feed mechanism inside downstream machine Z will typically be continuous and not stop-and-start, unless sheet L' is restrained from movement towards downstream machine Z, it will not enter a downstream machine Z simultaneously with right sheet R'. Accordingly, when simultaneous entry is required, a way of selectively restraining the cut sheets L', R' from movement downstream towards machine Z is necessary. Such selective restraining allows sheets L', R', to be fed and travel downstream in a predetermined sequence. The predetermined sequence by which the side-by-side sheets travel can comprise either simultaneous (with their leading edges coincident) or sequential (one after the other) as dictated by machine software control. Note that while the invention is described with reference to the left sheet L' being cut before right sheet R', it is equally possible for right sheet R' to be cut before left sheet L' and which order of cutting is a function of the cutter 10 be used.

Figure 2:
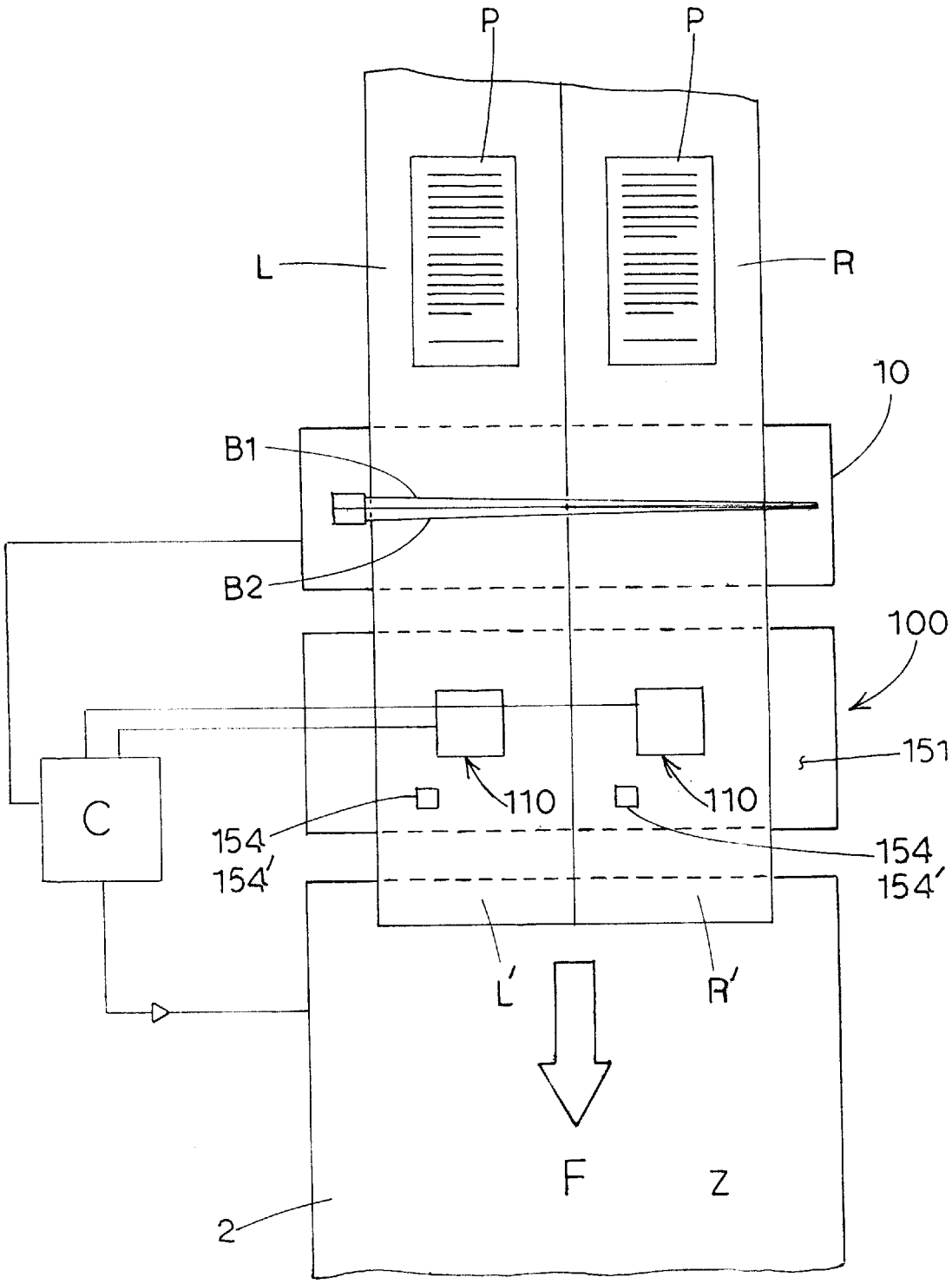
FIG. 2 of the drawings is a plan schematic view of a cutter stager according to the invention.
Figure 3:
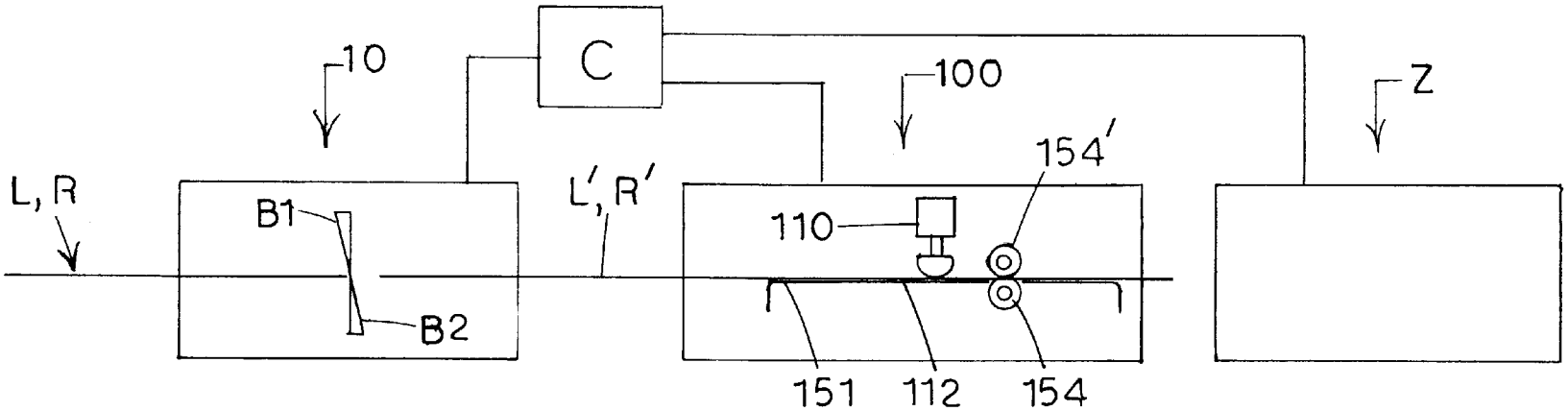
FIG. 3 of the drawings is an elevation schematic view of a cutter stager application according to the invention.

To synchronize the sheet cutting, staging, and feeding operations, as shown in FIG. 2, cutter stager 100 according to the invention is placed immediately after the exit to cutter 10 and before downstream machinery Z. Cutter stager 100 is provided with a mechanism for independently and selectively restraining each of sheets L', R' so that sheets L', R', may be fed in a predetermined sequence including sequential or simultaneous. Typically, it is foreseen that mechanism for independently and selectively restraining each of sheets L', R' will comprise at least one holding mechanism 110 per sheet L', R'. Each holding mechanism will be positioned above sheets L', R' (FIG. 3) so that when in the sheet hold position, sheets L', R' are clamped between holding mechanism 110 and plate 151, which will be described in more detail below. By operation of a controller, typically in the form of an electronic controller C, which will be in communication with sensors (not shown) located both in the cutter (so stager 100 knows when the sheets are cut) and at a downstream location such as within downstream machinery Z (so that stager 100 knows when the sheets it is holding are needed by downstream machinery Z), will control holding mechanisms 110 so as to hold or release its respective sheet L', R'.

Figure 1:
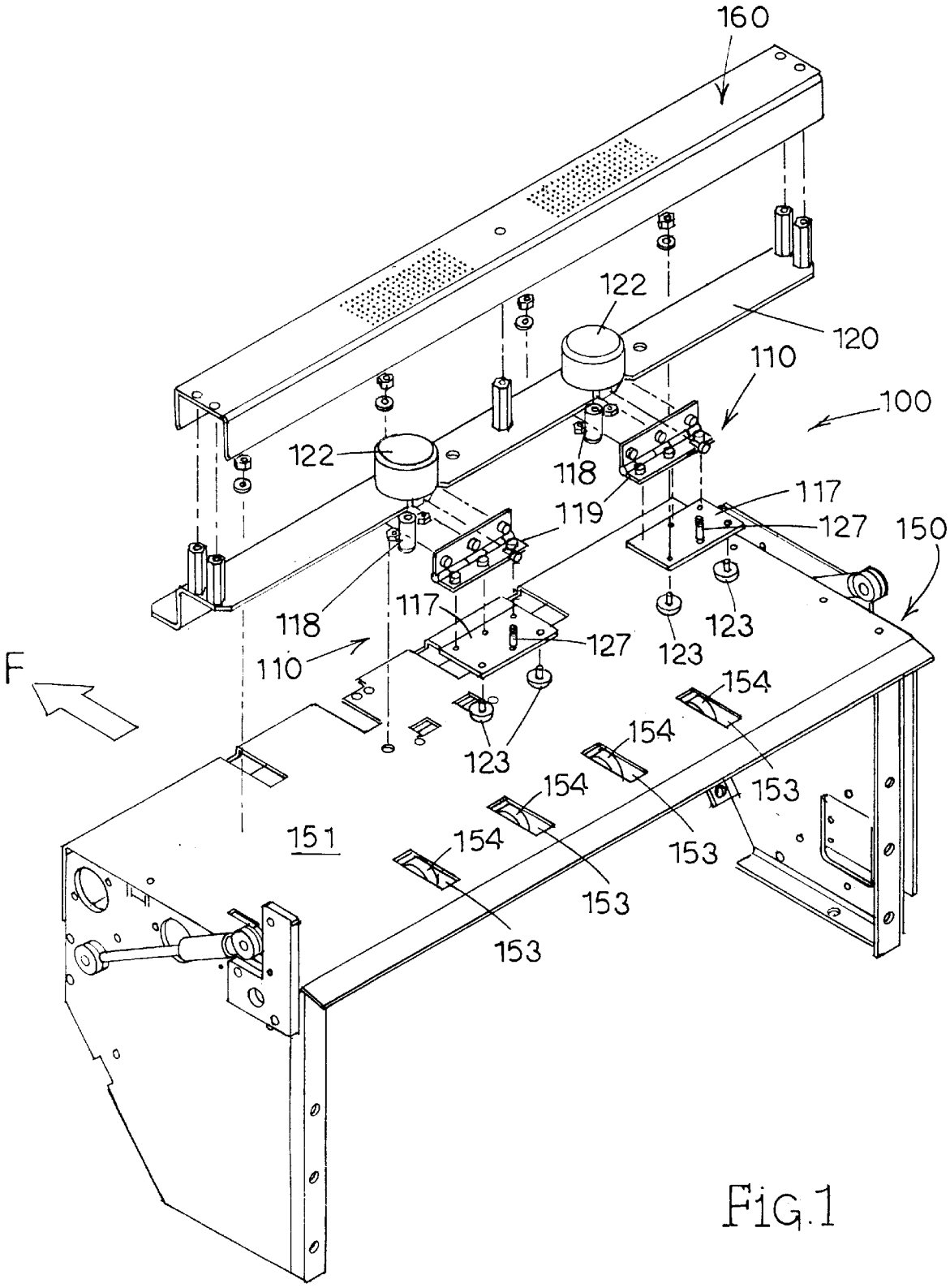
FIG. 1 of the drawings is an exploded perspective assembly view of a cutter stager according to the invention.

FIG. 1 of the drawings is a detailed exploded perspective assembly view of a first preferred embodiment of stager 100. Generally, stager 100 comprises lower support structure 150 and upper support structure 160. Lower support structure 150 includes feed plate 151 over which web and sheet material is fed. To feed this web and sheet material, cut-outs 153 are provided through which driven feed rollers 154 will protrude. These feed rollers 154, in combination with overhead idler rollers 154' (FIG. 3), will feed sheet or web material downstream in the direction of arrow F.

Upper support structure 160 supports the overhead mechanism for independently and selectively restraining each of sheets L', R', typically in the form of holding mechanisms 110. As shown in Figure One, each holding mechanism 110 is supported by bracket 120, which is mounted overfeed plate 151 by a top plate (not shown) and hinged at both ends of lower support 150. Each holding mechanism 110 is contemplated to be operated by its own solenoid 122. Solenoid 122 will have a plunger 118 which will retract or expand, dependent upon whether the solenoid is actuated. The actual sheet holding is the function of pads 123, typically in the form of high friction rubber pads. Pads 123 are interconnected with solenoids 122 so as to be raised and lowered (reciprocated) thereby. The interconnection between solenoids 122 and pads 123 is achieved by use of hinge 119 and hinge plate 117. Finally, extension springs 127 are provided. Springs 127 bias hinge plate 117 in the up position, with pads 123 away from a paper surface, when solenoid 122 is deactuated.

Each holding mechanism 110 operates as follows. Upon receiving the proper signal from controller C, solenoid 122 will be actuated, thereby extending plunger 118. Plunger 118, since it is attached to hinge 119 will lower hinge 119 and hinge plate 117. The lowering of hinge plate 117 downward brings pads 123 downward, where they will come into contact with a sheet or web surface as will be described below. Finally, when solenoid 122 deactuates due to a signal from controller C, springs 127 cause hinge 119 and hinge plate 117 to pivot upward, taking pads 123 out of contact with a sheet or web surface as will be described.

Having described the structure and general operation of the various component parts of cutter stager 100, its overall structure and integration with a cutter 10 and downstream machinery Z will now be described.

In the mail processing arts, the term "two-up forms" refers to two forms that are fed side-by-side through at least a portion of the sheet handling process. To create such two-up sheets, printed material is slit along its longitudinal center axis. With two-up material, it is possible that the sheets separated by the slit either belong to the same overall document or adjacent (i.e., current and next) documents. Typically those documents involve some type of financial statement, whereby indicia for one page is on one side of the slit and indicia for the other page is on the other side of the slit.

Cutter 10 will typically be positioned immediately after the slitter module (not shown), which will have taken a double-wide web of printed material, slitted it down its longitudinal center axis into to separate webs L, R. Webs L, R, will be fed into the receiving (entrance) end of cutter 10, through the blade pair B1, B2 of cutter 10 and then out the exit end of cutter 10, where it will enter cutter stager 100. Note that at this point, blades B1, B2 of cutter 10 have not performed their cutting function.

After it is determined, either by sensors (not shown) or machine timing, that webs L, R, have been fed over plate 151 and are positioned under their respecting holding mechanisms 110, controller C will first signal the web feeding process to stop and staging to begin. Then the holding mechanisms 110 will be activated along with cutter blades B1 and B2. Activating holding mechanisms 110 comprises energizing (actuating) solenoids 122, thereby extending plungers 118. Since plungers 118 are connected to pads 123 via hinge 119 and hinge plate 117, pads 123 will pivot downwards towards the top surfaces of webs L, R. When plunger 118 are fully extended and therefore pads 123 fully lowered, webs L, R will be pinched between pads 123 and plate 151. The relative coefficients of friction are such that webs L, R are now immobilized and the sheet feeding process has been stopped. Note, however, that due to the webs L, R, being immobilized because of pads 123 and plate 151, there is no need to stop the actual web feeding mechanisms (not shown) on each side of cutter stager 100. By lightly biasing the conventional feeding mechanism, typically in the form of pinch rollers, sheet damage is minimized despite the relative movement between sheet material and rollers (also belts can be substituted). It is possible, however, to stop and start all sheet feed mechanisms.

Cutter 10 is then given the signal to perform its cutting function. Cutter 10 will typically be of the type having a guillotine-like operation. That is, over and under blades B1, B2, with a small angular relationship between their surfaces will cut webs L, R between them (FIG. 4). Due to the angular relationship between the blade surfaces, a scissors-like operation will occur in cutter 10, and the web closest to the wider side of blade B1 will be severed from its web to form a sheet before the other web is severed.

When all the sheet feed mechanisms are continuously operated as in the preferred embodiment, without some means for restraining or holding back the cut sheet, it would be fed downstream in advance of the sheet web that had not been cut yet. This at times is undesirable since it is sometimes preferred that the two sheets have the same leading edge (i.e., fed simultaneously).

The means for holding described above eliminates this undesirable sequencing and allows for the sheets to be fed downstream in any predetermined sequence. Since each web side is immobilized by its respective means for holding when it is severed by the scissors-like operation of cutter 10, it cannot and therefore will not be fed downstream until released. After both sheets are severed by the scissors-like operation, the holding means for each sheet will be deactivated in a predetermined sequence, letting the sheets be either simultaneously or sequentially fed downstream. The process is then repeated for each set of sheets to be cut.

Figure 6:
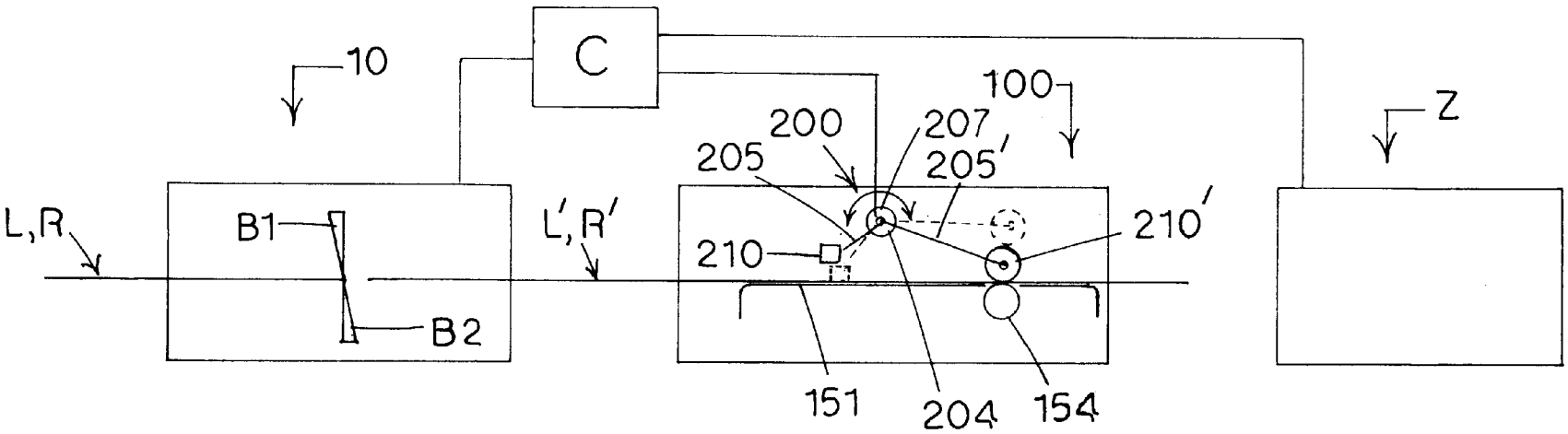
FIG. 6 of the drawings is an elevation view of a second embodiment of a cutter stager according to the invention.

While the staging interface apparatus and method according to the invention has been described with reference to using two solenoid activated rubber pads 123, other configurations are possible. For example, as shown in FIG. 6, two v-shaped idler roller mechanisms 200 can be used. Mechanism 200 comprises two bars 205, 205' joined together at a vertex 204. Bar 205 has a fixed rubber pad 210, similar to pads 123, at its free end and immediately over plate 151. Bar 205' has idler roller 210' at its free end and immediately over driven roller 154. Vertex 204, which may be in the form of an axle, is connected to the output shaft of a rotary motor 207. Operation of this embodiment is simple. When a sheet needs to be staged, motor 207 is actuated to pivot pad 210 downward toward plate 153. A paper sheet is then clamped between pad 210 and plate 151 and therefore unable to move. Thus, the sheet is being staged upstream until it is ready to be fed downstream. Upon receipt of a signal indicating that the sheet should be fed downstream, motor 207 is actuated to pivot idler roller 210' downward towards driven feed roller 154. A paper sheet is then clamped between idler roller 210' and driven feed roller 154 and thus fed downstream by the roller pair. Upon receipt of another signal, motor 207 is actuated to cause the next sheet to be clamped between plunger 210 and plate 151, so the process can be repeated.

The above description is directed to a stager interface apparatus and method for staging sheets. However, it will be understood that various details of the invention may be changed without departing from the scope of the invention. Furthermore, the foregoing description is for purpose of illustration only, and not for purpose of limitation, as the invention is defined by the following, appended claims.

It will be understood that various details of the invention may be changed without departing from the scope of the invention. Furthermore, the foregoing description is for the purpose of illustration only, and not for the purpose of limitation, as the present invention is defined by the following, appended claims.

What is claimed is:

1. A method for staging sheets, comprising the steps of:

(a) providing first and second webs to a separator;

(b) feeding said first and second webs through said separator;

(c) stopping feeding said first and second webs after at least a portion of said first and second webs pass through said separator;

(d) separating said portions of said first and second webs that passed through said separator from the rest of said first and second webs to form first and second sheets; and (e) selectively feeding said first and second sheets in a predetermined sequence.

2. The method according to claim 1, wherein said step of stopping feeding comprises the step of separately stopping said first and second webs.

3. The method according to claim 2, wherein said step of separately stopping said first and second webs comprises independently stopping said first and second webs.

4. The method according to claim 3, wherein said step of independently stopping said first and second webs further comprises the step of using first and second overhead mechanisms, respectively.

5. The method according to claim 4, wherein said step of using first and second overhead mechanisms further comprises the step of using first and second overhead reciprocating mechanisms, respectively.

6. The method according to claim 2, wherein said step of separating comprises the step of cutting.

7. The method according to claim 6, wherein said step of cutting further comprises the step of completely cutting one of said sheets from its web before the other.

8. The method according to claim 7, wherein said step of stopping feeding comprises the step of stopping feeding before, during and after the step of cutting.

9. The method according to claim 4, wherein said step of using first and second overhead mechanisms further comprises the step of using first and second overhead rotating mechanisms, respectively.

10. The method according to claim 1, wherein said predetermined sequence comprises simultaneous release of said first and second sheets.

11. The method according to claim 1, wherein said predetermined sequence comprises sequential.

12. A cutter stager apparatus, comprising:

(a) a sheet feeding mechanism for feeding first and second side-by-side sheets cut by and coming out of a cutter; and (b) a sheet holding mechanism for holding said first and second side-by-side sheets in place after exiting said cutter, said sheet holding mechanism further comprising a controller for selectively releasing each of said first and second side-by-side sheets from said sheet holding mechanism to said sheet feeding mechanism.

13. The apparatus of claim 12, wherein said sheet holding mechanism comprises first and second sheet holding mechanisms for holding said first and second side-by-side sheets, respectively.

14. The apparatus of claim 13, wherein said first and second sheet holding mechanisms comprises first and second independently operable sheet holding mechanisms, respectively.

15. The apparatus of claim 14, wherein said first and second independently operable sheet holding mechanisms are positioned above said first and second side-by-side sheets, respectively.

16. The apparatus of claim 15, wherein said first and second independently operable sheet holding mechanisms comprise first and second reciprocating mechanisms, respectively.

17. The apparatus of claim 16, wherein said first and second reciprocating mechanisms comprise first and second solenoid operated mechanisms.

18. The apparatus of claim 15, wherein said first and second independently operable sheet holding mechanisms comprise first and second rotating mechanisms, respectively.

19. The apparatus of claim 18, wherein said first and second rotating mechanisms comprise first and second rotating motor operated mechanisms.

20. The apparatus of claim 12, wherein said controller simultaneously releases each sheet.

21. The apparatus of claim 12, wherein said controller sequentially releases each sheet.

* * * * *